US006213762B1

(12) United States Patent
Eichberger et al.

(10) Patent No.: US 6,213,762 B1
(45) Date of Patent: Apr. 10, 2001

(54) SHAFT FURNACE

(75) Inventors: Ernst Eichberger, Pichl bei Wels; Wilhelm Stastny, Alberndorf, both of (AT)

(73) Assignee: Deutsche Voest-Alpine Industrieanlagenbau GmbH, Dusseldorf (DE)

( * ) Notice: Subject to any disclaimer, the term of this patent is extended or adjusted under 35 U.S.C. 154(b) by 0 days.

(21) Appl. No.: 09/462,985

(22) PCT Filed: Jul. 10, 1998

(86) PCT No.: PCT/EP98/04292

§ 371 Date: Jan. 14, 2000

§ 102(e) Date: Jan. 14, 2000

(87) PCT Pub. No.: WO99/04045

PCT Pub. Date: Jan. 28, 1999

(30) Foreign Application Priority Data

Jul. 14, 1997 (AT) ..... 1197/97

(51) Int. Cl.[7] ..... C21B 7/14
(52) U.S. Cl. ..... 432/98; 432/95; 266/195
(58) Field of Search ..... 432/95, 97, 98, 432/100, 101; 266/195, 196, 197

(56) References Cited

U.S. PATENT DOCUMENTS

| | | | | |
|---|---|---|---|---|
| 2,862,808 | | 12/1958 | De Jahn . | |
| 3,704,011 | | 11/1972 | Hand | 432/98 |
| 4,336,131 | * | 6/1982 | Schmidt et al. | 266/195 |
| 4,413,812 | * | 11/1983 | Pirklbauer et al. | 432/98 |
| 6,086,653 | * | 7/2000 | Joo et al. | 266/195 |

FOREIGN PATENT DOCUMENTS

| | | |
|---|---|---|
| 387037 | 11/1988 | (AT) . |
| 2659670 | 7/1977 | (DE) . |
| 0085290 | 8/1983 | (EP) . |
| 0166679 | 1/1986 | (EP) . |
| 98/21537 | 5/1998 | (WO) . |

* cited by examiner

*Primary Examiner*—Gregory Wilson
(74) *Attorney, Agent, or Firm*—Ostrolenk, Faber, Gerb & Soffen, LLP

(57) ABSTRACT

The invention relates to a shaft furnace (1), particularly to a direct-reduction shaft furnace, with a bed (2) of lumpy material, particularly lumpy material containing iron oxide and/or sponge iron, with discharge devices (4) for lumpy material which are located above the bottom area (3) of the shaft furnace (1), as well as with inlet ports (6) for a reduction gas which are arranged above the discharge devices (4). Arrangements (7) for moving the material in the shaft furnace (1) are located between the area formed by the inlet ports (6) and that formed by the discharge devices (4).

15 Claims, 5 Drawing Sheets

SHAFT FURNACE

BACKGROUND OF THE INVENTION

The invention relates to a shaft furnace, particularly to a direct-reduction shaft furnace, with a bed of lumpy material, particularly lumpy material containing iron oxide and/or sponge iron, wherein discharge openings for lumpy material are located above the bottom area of the shaft furnace and inlet ports for reduction gas above the discharge openings.

Many shaft furnaces, particularly reduction shaft furnaces of the aforementioned type, are known from prior art. Such a shaft furnace, which is essentially designed as a cylindrical hollow body, generally contains a bed of lumpy material containing iron oxide and/or sponge iron, with the lumpy material containing iron oxide being charged into the upper part of the shaft furnace. Reduction gas coming, for example, from a melter gasifier is injected into the shaft furnace and thus into the solid bed through several inlet ports arranged along the circumference of the shaft furnace in the area of the lower third of the shaft furnace. The hot, dust-laden reduction gas ascends through the solid bed, completely or partially reducing the iron oxide of the bed to sponge iron.

The completely or partly reduced iron oxide is extracted from the shaft furnace by means of discharge devices located between the bottom area of the shaft furnace and the area of the gas inlet ports. These discharge devices are usually designed as radially (related to the shaft furnace) arranged discharge screws.

The zone located in the area of the shaft bottom in which the discharge devices are arranged must have a maximum active discharge area in order to allow the bulk material to subside as uniformly as possible and to ensure continuous movement and mixing of the material in the reaction zone.

However, the small number of discharge devices and the involved space conditions have the disadvantage that part of the bulk material located in the plane of the discharge devices cannot be covered by these discharge devices so that nonmovable zones with very steep inner angles of repose are formed above these nonactive areas.

These zones, which are referred to as "dead man", have the disadvantage that a portion of the reaction space volume becomes partly inactive, active volume meaning the region of a shaft furnace where the desired gas-solid reactions occur.

As a result, cakings and agglomerates may form in these regions owing to the long dwelling times of ores and of already reduced ores, which impair the material flow and consequently reduce the material reaction and, thus, also the productivity.

The prior-art arrangement essentially features two zones above which "dead man" forms, that is, the central region not covered by the radially arranged discharge devices and another zone formed by two wedge-shaped regions located between two discharge devices each, wherein the bulk pyramids building up in these dead zones impede the solid flow and build up to a level where the reduction gas inlet ports are concealed by the bulk material that is building up and the dust freight of the reduction gas forms a bed that is relatively impermeable to gas. As a result, the required homogeneous gas distribution in the shaft furnace does not take place.

EP-B-0 116 679 describes screws for moving solid particles in a shaft furnace and for discharging such particles. These radially arranged and overhung screws are of identical length and have a cylindrical cross section. Although the dead corners between the screws are minimized by the installation of wedge-shaped baffles, "dead men" cannot be prevented from building up.

EP-B-0 085 290 reveals arrangements of short conical screws supported in a tapered baffle located in the center, which also serves as angle of repose, as well as along the circumference of the shaft furnace. Although the formation of a central "dead man" can be minimized through the wedge-shaped baffle located in the center, there are still inactive zones between adjacent discharge devices, which lead to the formation of undesirable bulk pyramids as already mentioned.

None of the arrangements of discharge devices and/or baffles known from prior art is capable of preventing the formation of bulk pyramids referred to as "dead man" between two adjacent discharge devices each at the inner edge of the shaft furnace.

Accordingly, the object of this invention is to avoid the formation of bulk pyramids between two adjacent discharge devices each at the inner edge of the shaft furnace or to reduce such formation to an extent that the tips of the bulk pyramids are located considerably below the area of the reduction gas inlet ports and the latter are no longer concealed by nonmovable bulk material.

SUMMARY OF THE INVENTION

The invention is characterized in that devices for moving the material in the shaft furnace are located between the area of the gas inlet ports and that of the discharge devices.

The moving devices, arranged according to the invention, effectively prevent the build-up of bulk pyramids in and above the area of the gas inlet ports. Owing to this arrangement, the reaction material is extensively mixed and lowered particularly in the upper part of the shaft, i.e. the area of the reaction space where reduction processes take place.

The number of devices for moving the material in the shaft furnace is preferably double the amount of discharge devices for lumpy material. The large number of moving devices ensure a homogeneous discharge of the reaction material.

According to a specially preferred design, two moving devices each are allocated in pairs to one discharge device each so that either of the two moving devices is located above as well as beside the discharge device, one on the left and the other one on the right. Owing to this special arrangement of moving devices according to the invention, removal of bulk pyramids starts from their edges. As a result, the height of the bulk pyramid is considerably reduced and therefore can no longer cover the gas inlet ports located along the circumference of the shaft furnace, which ultimately leads to a homogeneous gas distribution in the shaft furnace. Moreover, the active volume of the reaction space is increased thereby.

According to a preferred embodiment, the moving devices are designed as screw conveyors whose helicoids have an infinitely high pitch, if necessary, at least over a partial area of one screw conveyor each.

According to a feature of the invention, the helicoids of the screw conveyors are comprised of exchangeable paddles and/or paddles fixed to the shafts of the screw conveyors. Previous experience has shown that such paddles are exposed to high mechanical and abrasive stresses while material containing iron oxide and/or sponge iron is being moved. When maintenance work is to be carried out at the screw conveyors, it is very advantageous not to have to replace the entire screw but only the damaged paddles.

According to another feature of the invention, the shafts of the screw conveyors are overhung, i.e. cantilevered, and cooled, if necessary. Although the shafts have an essentially cylindrical shape, they can be designed with a constant and/or inconstant inward pitch, i.e. tapered towards the center of the shaft furnace, at least over a partial area of their length.

According to another feature of the invention, the envelope of the helicoids of one screw conveyor each is essentially cylindrical but can be designed with a constant and/or inconstant inward pitch, if necessary, at least over a partial area.

The flexible design of shafts and/or helicoids allows adjusting the conveying behavior of the screw conveyors to the fluid dynamics of the material to be conveyed.

According to another feature of the invention, the helicoid of each screw conveyor is designed in a way that each screw conveyor conveys towards or from the center of the shaft furnace or radially to the screw conveyor.

According to another feature of the invention, the screw conveyors are axially movable for temporary service. This embodiment has the advantage that each screw conveyor is easily accessible for the purpose of maintenance work and that it is not necessary to permanently operate each screw conveyor but that they can be temporarily used for removing the bulk pyramids.

According to another feature of the invention, the direction of rotation of each individual screw conveyor is continuous or discontinuous, clockwise or anticlockwise, or oscillating.

Owing to the flexible motion and direction of rotation, the relevant geometrical conditions of the bulk pyramids can be taken into account. Moreover, the reaction material is homogeneously mixed.

According to a preferred embodiment of the invention, the oscillation or rotation of two screw conveyors each allocated in pairs to one discharge device is oppositely directed. According to this preferred embodiment, the conveying direction is essentially radial but may also have a minor axial component, if necessary.

According to another embodiment of the invention, the head of each screw conveyor is designed as drill bit in a manner known in general, which allows boring into a bulk pyramid caked together in temporary service.

According to another embodiment of the invention, motors are provided to drive the shafts of the screw conveyor. Driving the shafts by means of motors allows flexible adjustment of the screw conveyors to the process and facilitates installation and dismantling because the drive is mounted on the traveling device anyway.

According to an embodiment of the invention, sensors are provided to identify the boring behavior of the screws. An undesirable boring behavior of a screw, for example, means that the screw head deviates from the desired direction during boring into a bed that may have partially caked. Boring is a sensitive process that may cause expensive repair work in case of maloperation by the personnel. Hence, sensors form an essential part of process control.

According to another feature of the invention, the speeds and/or the boring behavior of the individual shafts of the screw conveyors are controlled according to the conveying characteristics and/or the boring behavior, so the motion characteristics of the screw and of the boring head can be adjusted to the relevant process requirements.

DESCRIPTION OF THE PREFERRED EMBODIMENTS

Figure 1:
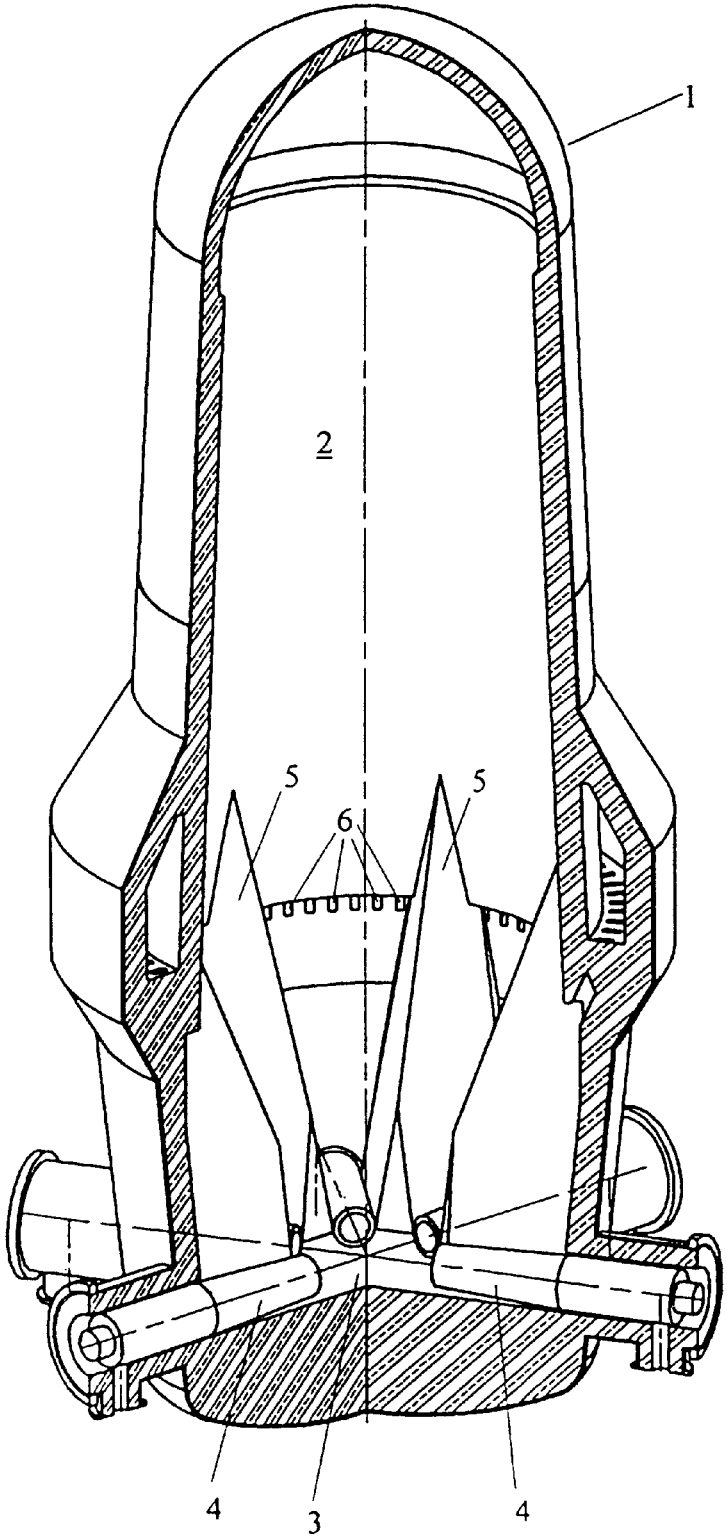
FIG. 1: Shaft furnace with discharge devices and bulk pyramids, without moving devices

FIG. 1 represents the problem to be solved: The interior of shaft furnace 1 contains solid bed 2 which is discharged from shaft furnace 1 through discharge devices 4 radially arranged above bottom 3 of shaft furnace 1. Between radially arranged discharge devices 4 (designed as screw conveyors; not represented), high bulk pyramids 5 have built up which project over part of gas inlet ports 6 and conceal the latter. The active volume of shaft furnace 1 is reduced by the volume of bulk pyramids 5, and the gas permeability of the solid bed is not uniform.

Figure 2:
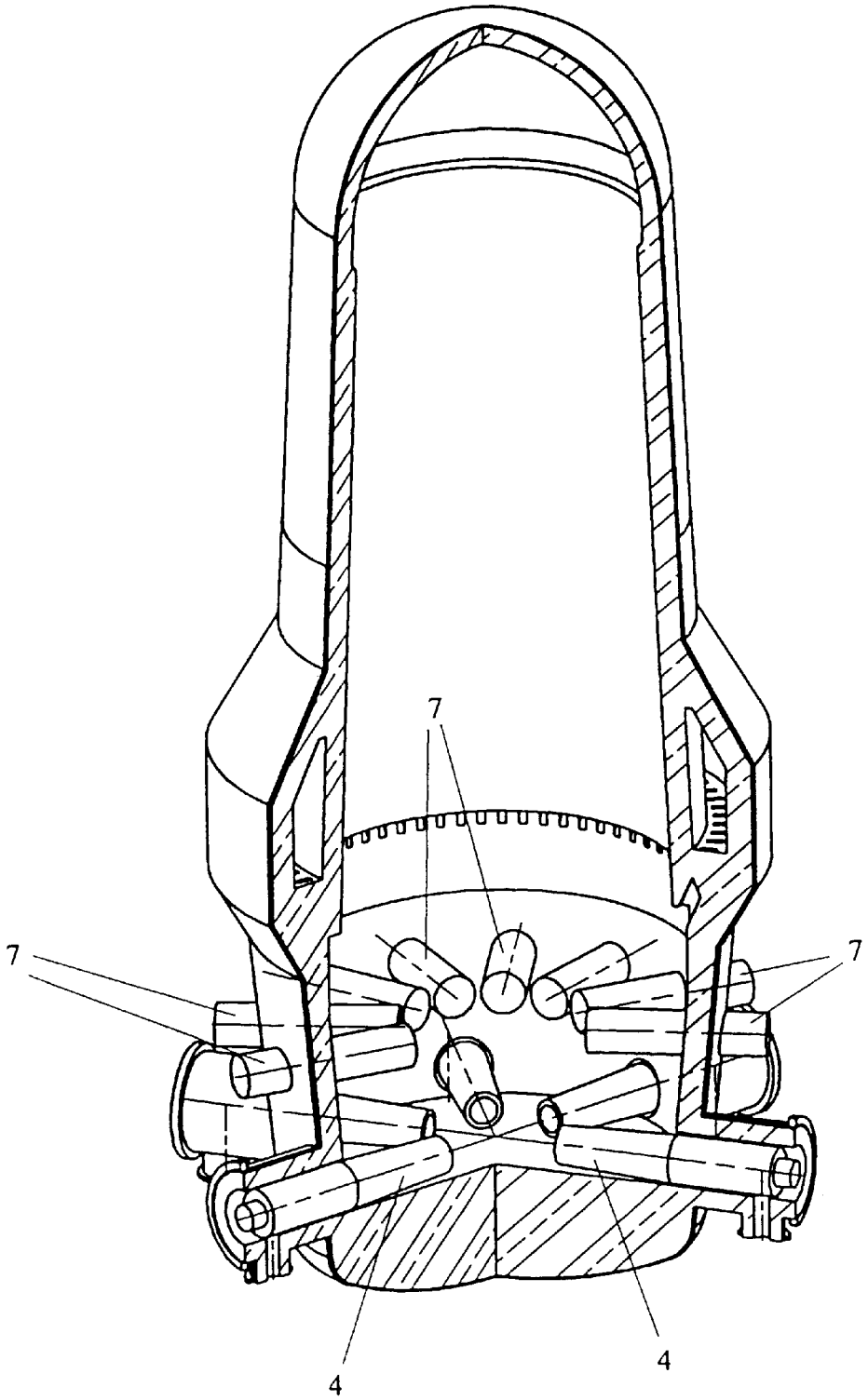
FIG. 2: Shaft furnace with discharge devices and moving devices

FIG. 2 displays shaft furnace 1 with moving devices 7 arranged according to the invention. To each discharge device 4, two moving devices 7 are allocated which are located both above and beside discharge device 4, one on the left and the other one on the right.

Figure 3:
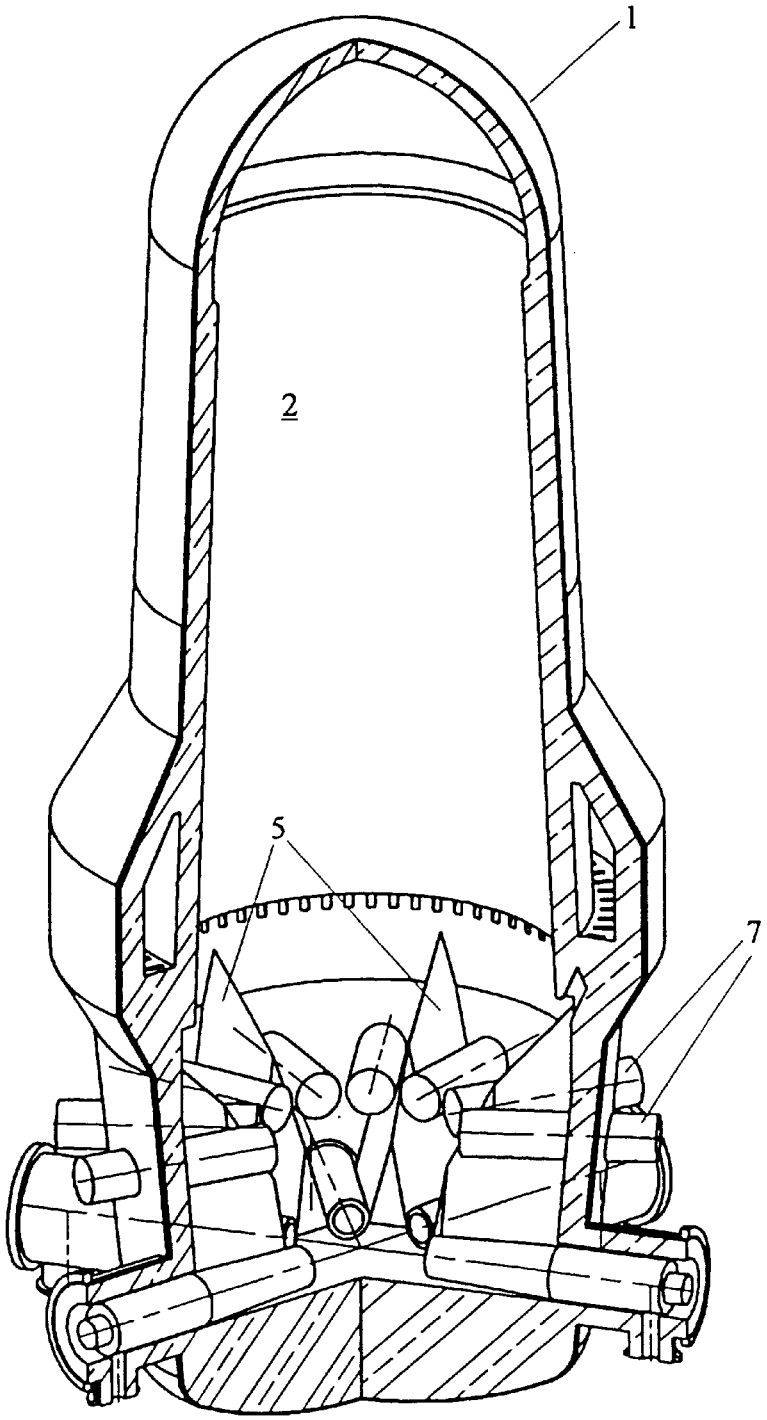
FIG. 3: Shaft furnace with discharge devices, moving devices and reduced bulk pyramids

FIG. 3 displays shaft furnace 1 with moving devices 7 arranged according to the invention as well as bulk pyramids 5 reduced because of the use of moving devices 7 arranged according to the invention. Gas inlet ports 6 are no longer concealed by bulk pyramids 5. Solid bed 2 features uniform gas permeability, and the active volume of shaft furnace 1 is increased.

Figure 4:
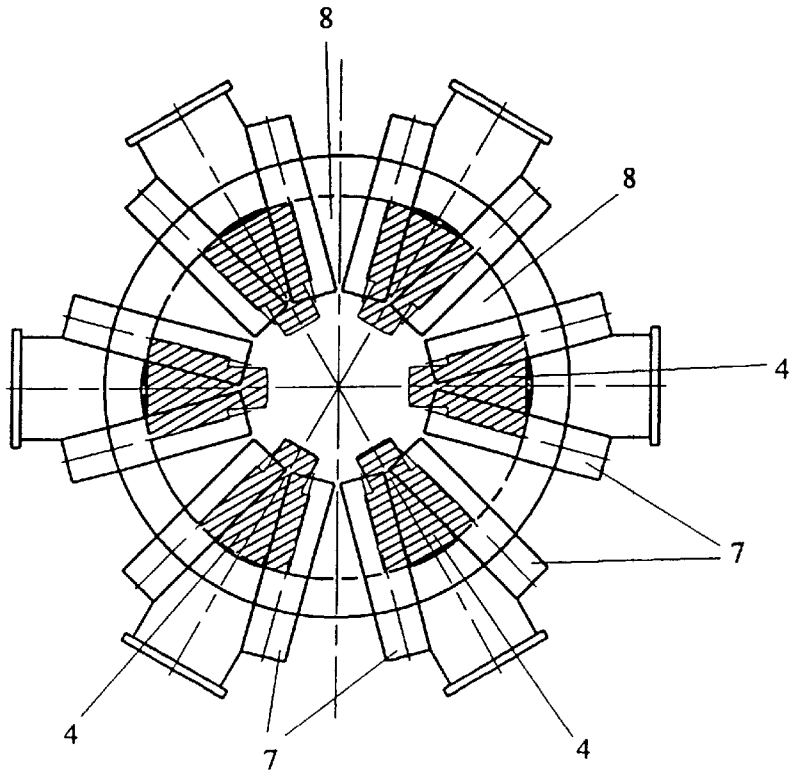
FIG. 4: Top view of the plane of moving devices with discharge devices located underneath

FIG. 4 displays a top view of the plane of moving devices 7 with discharge devices 4 located underneath. Two moving devices 7 are allocated to each discharge device 4, so wedge-shaped region 8 between two discharge devices 4 above which bulk pyramids build up is reduced.

Since the angle of repose is a constant variable depending on the material, the height of the bulk pyramid is reduced as its base decreases.

Figure 5:
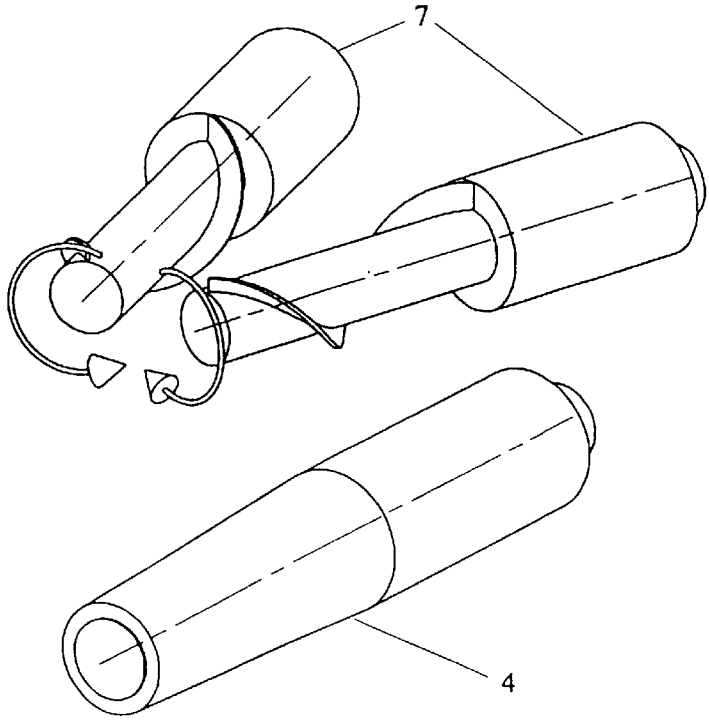
FIG. 5: Detail view of a discharge device with moving devices located above

FIG. 5 displays a detail view of discharge device 4 with two moving devices 7 located above which are designed as screw conveyors in this case. Arrows 8 indicate the directions of rotation of moving devices 7, which are opposed to each other so that material is conveyed from the bulk pyramids (not represented here) to the discharge area of discharge devices 4.

Figure 6:
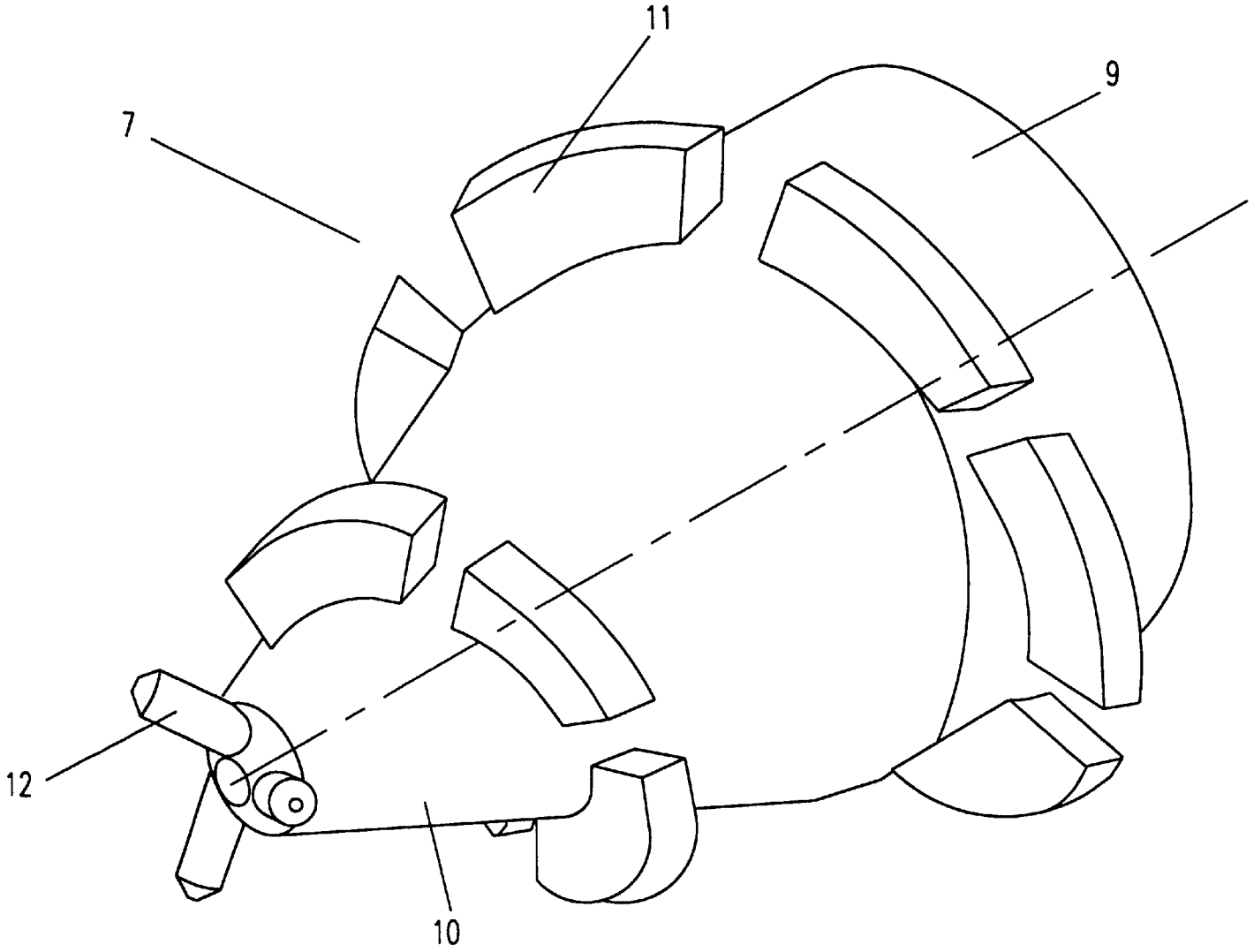
FIG. 6 is a schematic representation of a screw conveyor with paddles.

FIG. 6 displays a schematic view of a conveyor 7. The conveyor includes a shaft having a cylindrical portion 9 and a tapered portion 10, on which are mounted paddles 11 and drill bits 12, serving as the points of the conveyor.

What is claimed is:

1. Shaft furnace (1), particularly direct-reduction shaft furnace, with a bed (2) of lumpy material, particularly lumpy material containing iron oxide and/or sponge iron, with discharge devices (4) for lumpy material which are designed as screw conveyors and located above the bottom area (3) of the shaft furnace (1), as well as with inlet ports (6) for a reduction gas, which are located above the discharge devices (4), characterized in that arrangements (7) for moving the material in the shaft furnace (1) are located between the area formed by the inlet ports (6) and that formed by the discharge devices (4).

2. Shaft furnace (1) according to claim 1, characterized in that the number of arrangements (7) for moving the material in the shaft furnace (1) is at least double the amount of discharge devices (4) for lumpy material.

3. Shaft furnace (1) according to claim 1, characterized in that two moving devices (7) are allocated in pairs to one discharge device (4) each in a way that either of the two moving devices (7) is located both above and beside the discharge device (4), one on the left and the other one on the right.

4. Shaft furnace (1) as claimed in claim 1, characterized in that the moving devices (7) are designed as horizontally arranged screw conveyors.

5. Shaft furnace (1) according to claim 4, characterized in that the shafts of the screw conveyors are overhung in the area of the furnace wall and cooled, if necessary.

6. Shaft furnace (1) as claimed in claim 4, characterized in that the shafts of the screw conveyors are essentially cylindrical and, if necessary, taper at a constant and/or inconstant pitch as their distance from the furnace wall increases, at least over a partial area of their length.

7. Shaft furnace (1) as claimed in claim 4, characterized in that the helicoids of the screw conveyors have an infinitely high pitch at least in a partial area.

8. Shaft furnace (1) as claimed in claim 4, characterized in that the helicoids of the screw conveyors are comprised of exchangeable paddles and/or paddles fixed to the shafts.

9. Shaft furnace (1) as claimed in claim 4, characterized in that the envelope of a helicoid is essentially cylindrical and, if necessary, tapers inwards at a constant and/or inconstant pitch at least over a partial area.

10. Shaft furnace (1) as claimed in claim 4, characterized in that each screw conveyor is designed in a way that it conveys either towards or from the center of the shaft furnace (1) or radially to the screw conveyor.

11. Shaft furnace (1) as claimed in claim 4, characterized in that each screw conveyor is axially movable for permanent and/or temporary service.

12. Shaft furnace (1) as claimed in claim 4, characterized in that each screw conveyor is capable of rotating continuously or discontinuously, clockwise or anticlockwise.

13. Shaft furnace (1) as claimed in claim 4, characterized in that the oscillation and/or rotation of two screw conveyors each allocated in pairs to a discharge device (4) is oppositely directed.

14. Shaft furnace (1) as claimed in claim 4, characterized in that the points of the screw conveyors are designed as drill bits.

15. Shaft furnace (1) as claimed in claim 4, characterized in that motors are provided to drive the shaft s of the screw conveyors.

* * * * *